United States Patent [19]

Ricci

[11] Patent Number: 4,553,481

[45] Date of Patent: Nov. 19, 1985

[54] SHOT GUN SHELL TRACER WAD

[76] Inventor: Vero Ricci, 106 E. Stiles Ave., Collingswood, N.J. 08108

[21] Appl. No.: 599,093

[22] Filed: Apr. 11, 1984

[51] Int. Cl.[4] ..... F42B 7/02

[52] U.S. Cl. ..... 102/458

[58] Field of Search ..... 102/448–463, 102/532

[56] References Cited

U.S. PATENT DOCUMENTS

| | | | |
|---|---|---|---|
| 1,304,962 | 5/1919 | Gravely . | |
| 1,305,115 | 5/1919 | Jewett . | |
| 1,363,043 | 12/1920 | Jewett . | |
| 3,142,254 | 7/1964 | Grinzenberger . | |
| 3,262,390 | 7/1966 | Cowles et al. . | |
| 3,289,586 | 12/1966 | Horn et al. . | |
| 3,405,638 | 10/1968 | Stoner, Jr. . | |
| 3,503,332 | 3/1970 | De Gregorio | 102/450 |
| 3,515,070 | 6/1970 | Cutler et al. . | |
| 3,576,987 | 5/1971 | Voight . | |
| 3,597,362 | 8/1971 | Boilyky . | |
| 3,736,874 | 6/1973 | Gerber . | |
| 3,760,735 | 9/1973 | Schmitt . | |
| 3,788,224 | 1/1974 | Merritt . | |
| 3,940,605 | 2/1976 | Gerber . | |
| 4,064,428 | 12/1977 | Van Zandt | 362/34 |
| 4,080,899 | 3/1978 | Luban . | |
| 4,307,664 | 12/1981 | Vollers . | |
| 4,389,939 | 6/1983 | Ofuji . | |

FOREIGN PATENT DOCUMENTS

| | | | |
|---|---|---|---|
| 1470963 | 2/1967 | France | 102/449 |
| 2368683 | 5/1978 | France | 102/454 |

*Primary Examiner*—Harold J. Tudor

*Attorney, Agent, or Firm*—Panitch, Schwarze, Jacobs & Nadel

[57] ABSTRACT

A molded plastic wad for use in a shot shell having a primer propellant and shot comprises an upper, generally cylindrical shot compartment for receiving and holding the shot and a lower, generally enclosed chamber secured to the lower end of the shot compartment proximate the propellant. The lower chamber has side walls and a bottom wall comprised of an overpowder wad. Tracer means are positioned within the lower compartment for forming a chemiluminescent tracer to accompany the shot upon the firing of the shot shell.

5 Claims, 3 Drawing Figures

SHOT GUN SHELL TRACER WAD

BACKGROUND OF THE INVENTION

The present invention relates generally to a shot shell wad and, more particularly, to a unitary molded plastic shot shell wad which includes a chemiluminescent tracer feature as well as a shock absorbing chamber expansion feature.

It is desirable to be able to observe the flight path of the shot fired from a shotgun in order to improve accuracy and denote the fit of the shotgun to the shooter's physical structure. In the past, "tracer" amunition for shot shells has been of the flamable type whereby a compound or combination of compounds is ignited and burns to provide a visual indication of the path of the shot. Such prior art tracers are dangerous and sometimes result in the ignition of fires upon impact, for example with grass, brush, trees or the like, due to the chemical compounds not being completely burned. The present invention provides a shot shell wad having a chemiluminescent tracer element comprised of a non-toxic, non-flamable liquid which provides a bright illumination to clearly indicate the path of the shot.

In addition to the tracer feature, the present invention provides a shot shell wad having a collapsing/inversion feature which allows the overpowder wad to move slightly forward at time of primer ignition to allow additional combustion area and provide a shock absorbing effect to diminish the disturbance upon the shot column to maintain a tightly aligned shot column when the shot leaves the gun barrel.

SUMMARY OF THE INVENTION

Briefly stated, the present invention comprises a wad for use in a shot shell comprising an upper generally cylindrical shot compartment for receiving and holding shot and a lower, generally enclosed chamber secured to the lower end of the shot compartment. The lower chamber has sidewalls and a bottom wall comprised of an overpowder wad. Tracer means are positioned within the lower compartment for forming a chemiluminescent tracer to accompany the shot upon the firing of the shot shell.

BRIEF DESCRIPTION OF THE DRAWING

The foregoing summary, as well as the following detailed description will be better understood when read in conjunction with the appended drawing. For the purpose of illustrating the invention, there is shown in the drawing an embodiment which is presently preferred, it being understood, however, that this invention is not limited to the precise arrangement and instrumentality shown. In the drawing.

DESCRIPTION OF PREFERRED EMBODIMENT

Figure 1:
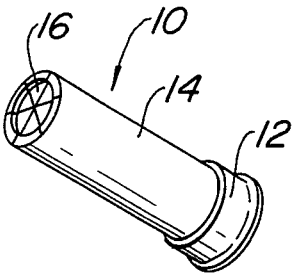
FIG. 1 is a perspective view of a shot gun shell formed with a shot shell wad in accordance with the present invention.

Referring to the drawing, wherein like numeral indicate like elements throughout, there is shown in FIG. 1 a perspective view of a shot gun shell, shown generaly as 10, including a shot shell wad in accordance with the present invention. The shot gun shell 10 includes a head 12 comprised of brass or any other suitable material and a generally cylindrical tube or roll 14 which may be comprised of a paper product. The upper end of the tube includes a crimp closure 16 for maintaining the shot, shot wad, etc. within the shell 10 as will hereinafter become apparent.

Figure 2:
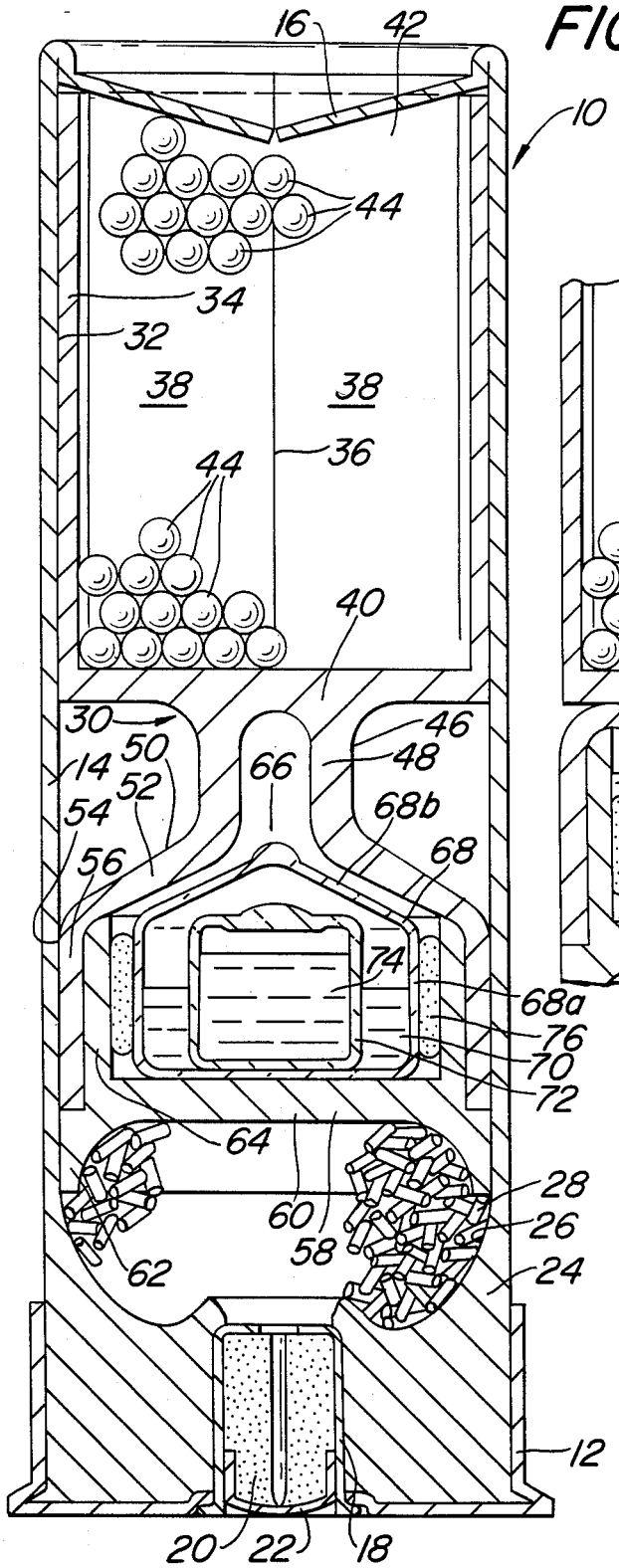
FIG. 2 is an enlarged sectional view of the shot shell of FIG. 1 showing the structural details of the shot shell wad.

As best seen in FIG. 2, the shot shell 10 further includes a lower primer pocket 18 within which is positioned primer mixture 20. The lower end of the primer pocket 18 is enclosed by a primer cap 22 in the usual manner. The primer pocket 18 is generally centrally positioned within the bottom of the shot shell as shown for ignition upon the fitting of a shotgun (not shown).

Surrounding the primer pocket 18 is a hull or base wad 24 comprised of a compression-molded material such as polypropylene, asbestos or paper. The base wad 24 cooperates with the primer pocket 18 to upwardly direct the ignition of the primer.

Positioned above the base wad 24 and primer pocket 18 is a combustion chamber 26. Located within the combustion chamber is the shot shell propellant or gun powder load 28 which may comprise generally cylindrical gun powder components as shown or may comprise tubular, spherical, or any other suitable type of gun powder (not shown).

Positioned above the combustion chamber 26 is the shot shell wad shown generally as 30. In the presently preferred embodiment, the shot shell wad 30 is of a design formed of molded plastic of the type well known in the art. The upper end of the shot shell wad 30 includes a first generally cylindrical portion 32 having side walls 34 with an outer diameter which is slightly less than the inner diameter of the tube 14. The upper end of the side walls 34 extend to just beneath the closure crimp 16. In the presently preferred embodiment, the upper cylindrical portion side walls 34 includes a plurality of longitudinal slits 36 (three of which are shown) which divides the side walls 34 into a plurality of flaps 38. A generally flat circular base member 40 is located at the lower longitudinal end of the upper cylindrical portion 32. The circular base member 40 and the cylindrical portion side walls 34 cooperate to form a generally cylindrical shot cup or shot compartment 42 within which is located lead shot, shown as a plurality of individual shot pellets 44 which combine to form a shot column. The crimp closure 16 at the top of the shot compartment 42 serves to enclose and retain the shot 44 within the compartment 42.

Positioned beneath and connected to the base member 40 is a downwardly extending generally cylindrical stem portion 46 having a common axis with the shot compartment 42. The stem portion 46 is comprised of side walls 48 having an outer diameter which is substantially less than the outer diameter of the shot compartment 42. For purposes which will hereinafter become apparent, the thickness of the stem portion side walls is substantially uniform and is also substantially greater than the thickness of the shot compartment side walls 34.

Positioned below and extending downwardly from the stem portion 46 is a generally conical portion 50. The conical portion 50 includes side walls 52 which at the upper end have a thickness and outer diameter which are substantially the same as that of the stem portion side walls 48. The conical portion side walls 52 then extend outwardly so that the lower end of the conical portion side walls 52 have an outer diameter which is substantially equal to the outer diameter of the shot compartment side walls 34. The conical portion side walls 52 are also generally equally tapered from a thicker portion at the upper end to a thinner portion at the lower end as shown.

A second generally cylindrical portion 54 extends downwardly from the lower end of the conical portion 50. The second cylindrical portion has side walls 56 with an outer diameter substantially equal to the outer diameter of the shot compartment side walls 34. The thickness of the second cylindrical portion side walls 56 is substantially equal to that of the thickness of the lower end of the conical portion side walls 52.

An overpowder wad 58 is disposed below and partially within the second cylindrical portion 54. The overpowder wad 58 includes a generally flat circular base portion 60 and an outwardly tapered skirt portion 62 which engage the propellant 28 as shown. A generally cylinrical portion 64 extends upwardly from the base portion 60. The overpowder wad cylindrical portion 64 has an outer diameter which is substantially the same as the inner diameter of the second cylindrical portion side walls 56 and telescope therein. The overpowder wad cylindrical portion 54 is attached by any suitable means, for example, sonic welding, to the second cylindrial portion sidewalls 56 to form a tight seal. In this manner, the overpowder wad 58 cooperates with the second cylindrical portion 56, the conical portion 50 and the stem portion 46 to form a generally enclosed, moisture tight and air tight chamber 66. As shown, the chamber 66 includes a generally cylindrical lower portion, a generally conically shaped middle section and a generally cylindrical upper portion.

Tracer means are provided within the chamber 66 for forming a chemiluminescent tracer to generally accompany the shot 44 as it leaves the barrel of the shot gun (not shown). In the presently preferred embodiment, the tracer means comprises a first frangible closed container 68 which contains an oxcylic-type chemiluminescent compound 70. In the presently preferred embodiment, the first frangible container 68 generally conforms to the shape of the chamber 66 and includes a generally cylindrical portion **68*a* and a generally conical portion 68*b***.

A second frangible closed container 72 is disposed within the first frangible container 68 as shown. In the presently preferred embodiment, the second frangible container is generally cylindrical and contains a hydroperoxide catalyst compound 74.

The quantity of each compound 70 and 74 is in a preferred ratio selected to provide a bright chemiluminescent light for a desired time period. Specific details concerning the two compounds 70 and 74, mixing ratios and the like can be obtained by referring to U.S. Pat. Nos. 3,576,987 and 3,597,362, each of which are hereby incorporated by reference.

As shown in FIG. 2, sufficient clearance is provided between the walls of the second frangible container 72 and the walls of the first frangible container 68 for both the oxcylic compound 70 and some additional airspace. In the presently preferred embodiment, both the first and second frangible containers 68 and 72 are comprised of glass. However, it will be appreciated by those skilled in the art that the first and second frangible containers may be comprised of any other suitable material as long as the selected material is of a type which will prevent the oxcylic-type compound 70 from migrating through the containers 68 and 70. Migration of the oxcylic-type compound 70 through the second container 72 may result in premature mixing of the two chemiluminescent compounds and migration through the first container 68 may dampen the gun powder 28.

Spacer means, in the presently preferred embodiment, a generally annular spacer member 76 is disposed around the outside of the first frangible container 68. In the presently preferred embodiment, the annular spacer member 76 has a radial thickness which is substantially equal to one-half of the difference between the outer diameter of the first frangible container cylindrical portion **68*a* and the inner diameter of the overpowder wad cylindrical portion 64. In this manner, the spacer member 76 serves to hold the first frangible container 68 in place within the chamber 66 and to serve as a shock absorber to prevent rattling and/or inadvertent breakage of the first frangible container 68. Although, in the presently preferred embodiment, the spacer means is comprised of a generally annular member 76**, the spacer means could alternatively be comprised of a plurality of individual foam particles or the like.

Figure 3:
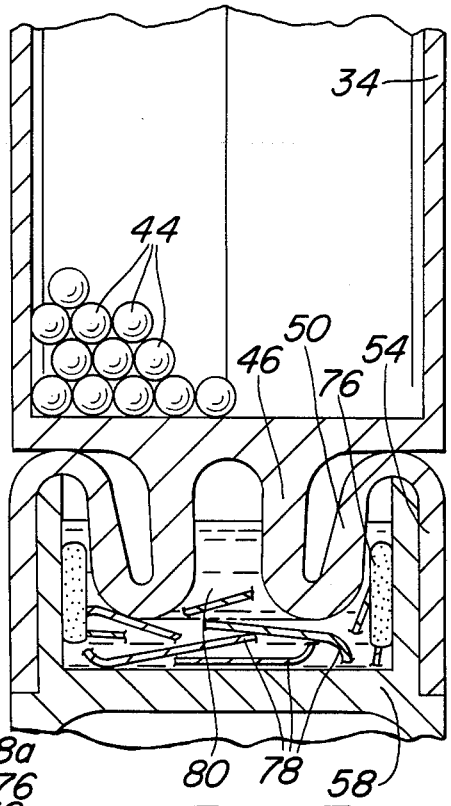
FIG. 3 is a view of a portion of the shot shell of FIG. 2 showing the structure of the shot shell wad after ignition of the primer.

Referring to FIG. 3, there is shown a view of the shot shell wad 30 after the primer 20 has been ignited. The wad 30 is specifically designed so that the overpowder wad 58 moves forward or upwardly as shown without movement of the shot compartment 42 which is held in place by the crimp closure 16. The upward movement of the over powder wad 58 results in the expansion of the combustion chamber 26 prior to ignition of the propellant 28 to effectively decrease the combustion chamber pressure created upon the combustion of the powder or propellant 28 prior to the movement of the shot 44 and to provide an even pressure distribution in the upward or forward direction. In this manner, a shock absorbing effect is created to protect the shot compartment 42 and to thereafter allow the shot 44 to later move forward or upwardly generally undisturbed.

The upward movement of the overpowder wad 58 causes the conical portion 50 to invert, therefore absorbing some of the shock and to assume the position as shown in FIG. 3. The location of the inversion is controlled by varying the thickness of the conical portion sidewalls 52 in a controlled manner. The upward movement of the overpowder wad 58 also pushes the first and second frangible containers 68 and 72 upwardly against the conical portion 50 and the stem portion 46 which function as an anvil, causing both of the frangible containers 68 and 72 to rupture and break into a plurality of pieces indicated as 78. The inversion of the conical portion 50 to form the anvil cooperates with the overpowder wad cylindrical portion 64 to limit the upward travel of the overpowder wad 58 to the position as shown in FIG. 3. The limitation on overpowder wad movement prevents the shot column from being disturbed. The spacer member 76 maintains the frangible containers 68 and 72 properly centered and aligned so that they properly engage the conical portion 50 and stem portion 46 for complete breakage of the containers 68 and 72. The spacer member 76 also absorbs some of the air within the chamber 66 which is compressed upon the upward movement of the overpowder wad 58.

Once the frangible containers 68 and 72 are broken, the two chemical compounds 70 and 74 are violently forced to mix with each other to form a single chemiluminescent compound indicated as 80 in FIG. 3 which gives off the desired illumination. The chemiluminescent compound 80 is contained within the now reduced sized chamber 66. Some of the chemiluminescent compound 80 may be absorbed by the spacer member 76.

Thereafter, upon ignition of the propellar 28, the pressure within the combustion increases chamber 26 against the bottom of the overpowder wad 58 and opens the crimp closure 16 so that the shot 40, the wad 30 and the chemiluminescent compound 80 are propelled out of the barrel of the shot gun (not shown) and traverse a common path, the trajectory of which is indicated by the chemiluminescent compound 80.

From the foregoing description it can be seen that the present invention comprises a unitary molded plastic shot shell wad which includes a chemiluminescent tracer feature as well as a shock absorbing feature to provide for a tight shot alignment within the shot column. It will be recognized by those skilled in the art that changes may be made to the above-described embodiment of the invention without departing from the broad inventive concepts thereof. It is understood, therefore, that this invention is not limited to the particular embodiment disclosed, but it is intended to cover all modifications which are within the scope and spirit of the invention as defined by the appended claims.

I claim:

1. In a shot shell having a primer, propellant and shot, a unitary molded plastic wad comprising:

a generally cylindrical shot compartment at the upper end of the wad with sidewalls having a first predetermined outer diameter for receiving and retaining the shot;

a generally cylindrical stem portion extending downwardly from the shot compartment along a common axis, the stem portion having sidewalls with an outer diameter less than the outer diameter of the shot compartment;

a generally conical portion having sidewalls and extending downwardly from the lower end of the stem portion along a common axis, the upper end of the conical portion having an outer diameter substantially equal to the outer diameter of the lower end of the stem portion and the lower end of the conical portion having an outer diameter substantially equal to the outer diameter of the shot compartment, the sidewalls of the conical portion being tapered from a first thickness at the upper end to a second thickness at the lower end;

a generally cylindrical portion extending downwardly from the lower end of the conical portion, the cylindrical portion having sidewalls and an outer diameter substantially equal to the outer diameter of the shot compartment;

an overpowder wad secured to the lower end of the cylindrical portion and engaging the propellant, the overpowder wad cooperating with the cylindrical portion, the conical portion and the stem portion to form a generally enclosed chamber whereby upon ignition of the shot shell primer the overpower wad moves upwardly into the chamber and the conical portion inverts to provide shock absorption for the shot compartment; and tracer means within the chamber for forming a chemiluminescent tracer to accompany the shot.

2. The shot shell as recited in claim 1 wherein the tracer means comprises:

a first frangible closed glass container comprising a lower generally cylindrical portion and an upper generally conical portion and containing an oxalic-type chemiluminescent compound; and a second generally cylindrical frangible closed glass container positioned inside of the first container and containing a hydroperoxide catalyst compound whereby the upward movement of the overpowder wad and the inward movement of the conical portion of the shot shell wad results in the breaking of the first and second frangible containers and the mixing of the oxalic-type compound and the hydroperoxide compound within the chamber to form the chemiluminescent tracer.

3. The shot shell as recited in claim 2 wherein the cylindrical portion of the first frangible container has an outer diameter which is less than the inner diameter of the cylindrical portion of the chamber and wherein spacer means are positioned between the outside of the first frangible container and the inside walls of the chamber to maintain the first frangible container in a relatively fixed position within the chamber.

4. The shot shell as recited in claim 3 wherein the spacer means is formed of a foam material.

5. The shot shell as recited in claim 4 wherein the spacer means is annular and encircles the cylindrical portion of the first frangible container, the annular spacer means having a radial thickness which is substantially equal to one half of the difference between the outer diameter of the cylindrical portion of the first container and the inner diameter of the cylindrical portion of the chamber.

* * * * *